United States Patent [19]

Ogita

[11] 4,150,648

[45] Apr. 24, 1979

[54] EXHAUST GAS RECIRCULATION ENGINE FOR HIGH ALTITUDE USE

[75] Inventor: Tamotu Ogita, Susono, Japan

[73] Assignee: Toyota Jidosha Kogyo Kabushiki Kaisha, Toyota, Japan

[21] Appl. No.: 849,508

[22] Filed: Nov. 7, 1977

[30] Foreign Application Priority Data

Oct. 3, 1977 [JP] Japan ..... 52-17952

[51] Int. Cl.[2] ..... F02M 25/06

[52] U.S. Cl. ..... 123/119 A; 123/75 D

[58] Field of Search ..... 123/119 A, 75 D; 60/278, 279

[56] References Cited

U.S. PATENT DOCUMENTS

| | | | |
|---|---|---|---|
| 3,924,589 | 12/1975 | Nohira | 123/119 A |
| 3,982,395 | 9/1976 | Hasegawa et al. | 123/119 A |
| 4,008,697 | 2/1977 | Konno | 123/119 A |
| 4,041,917 | 8/1977 | Suzuki | 123/119 A |
| 4,050,429 | 9/1977 | Yasuhiro et al. | 123/119 A |
| 4,056,083 | 11/1977 | Wakita | 123/119 A |
| 4,060,065 | 11/1977 | Hata et al. | 123/119 A |
| 4,069,797 | 1/1978 | Nohira et al. | 123/119 A |
| 4,071,003 | 1/1978 | Aono | 123/119 A |
| 4,090,482 | 1/1978 | Yushida | 123/119 A |

*Primary Examiner*—Wendell E. Burns

*Attorney, Agent, or Firm*—Stevens, Davis, Miller & Mosher

[57] ABSTRACT

Disclosed is an exhaust gas recirculation engine for high altitude use. The engine comprises an exhaust gas recirculation control valve device communicating an intake manifold with an exhaust manifold for circulating a part of the exhaust gas for reducing harmful $NO_x$ contaminants contained in the exhaust gas, which device is actuated by vacuum supplied from a vacuum port disposed at a position adjacent to a throttle valve of a carburetor, a reservoir tank for storing a vacuum; a control valve device for controlling the delivery of the vacuum from the reservoir tank; and an altitude compensating device for actuating the control valve device in accordance with the altitude.

Utilizing the above-described engine, exhaust gas is recirculated for a predetermined interval of time after the throttle valve has been opened at a level which is more than the predetermined level during high altitudes. However, exhaust gas is stopped from being recirculated as soon as the throttle valve is opened to the predetermined level during low altitudes. As a result, the amount of harmful $NO_x$ contaminants contained in the exhaust gas can always be maintained at a low level.

9 Claims, 2 Drawing Figures

EXHAUST GAS RECIRCULATION ENGINE FOR HIGH ALTITUDE USE

BRIEF DESCRIPTION OF THE INVENTION

This invention relates to an exhaust gas recirculation engine, especially to an exhaust gas recirculation engine which is preferable for use at high altitudes.

Well known exhaust gas recirculation engines are those which recirculate a part of the exhaust gas extracted from an exhaust system of the engine into an intake system of the engine for reducing harmful contaminants, especially nitrogen oxides ($NO_x$) contained in the exhaust gas. In these engines, the exhaust system and the intake system of the engine are communicated with each other via an exhaust gas recirculation control valve device, which is controlled in accordance with a predetermined program, so that a part of the exhaust gas in the exhaust system is recirculated into the intake system. Each of the various types of known exhaust gas recirculation control valve devices is actuated by vacuum supplied from a vacuum port formed at a position adjacent to a throttle valve disposed within the intake system.

When a vehicle, on which the above-mentioned exhaust gas recirculation engine is mounted, is operating at high altitudes wherein the density of the air (in other words, the specific weight of air) is reduced due to decreased atmospheric pressure, a drop in the engine power occurs. To compensate for the drop in the engine power, the throttle valve of the carburetor may be opened wider at higher altitudes than at lower altitudes. As a result, the pressure of the vacuum supplied from the vacuum port disposed in the intake system to the exhaust gas recirculation valve device can be lowered to a level less than a predetermined level above which the exhaust gas recirculation valve device is caused to be opened. Therefore, the exhaust gas recirculation valve device can be closed easily at high altitudes, and it will become impossible to fully achieve the effect of reducing harmful $NO_x$ contaminants contained in the exhaust gas.

However, no method or apparatus which can sufficiently compensate for the degradation of an exhaust gas recirculation engine caused by changes in the altitudes has been discovered yet.

SUMMARY OF THE INVENTION

An object of the present invention is to provide an exhaust gas recirculation engine which can obviate the above-mentioned problems and which can continue to supply an actuating vacuum to an exhaust gas recirculation control valve device for a predetermined interval of time at high altitudes after the throttle valve has been opened and the pressure of the vacuum supplied from the vacuum port disposed in the intake system is lowered to a level less than the level above which the exhaust gas recirculation valve device is caused to be opened.

Another object of the present invention is to provide an exhaust gas recirculation engine which can actuate an exhaust gas recirculation valve device at low altitudes in response to changes in the pressure of the vacuum supplied from a vacuum port disposed in an intake system due to the increased opening of the throttle valve.

A further object of the present invention is to provide an exhaust gas recirculation engine which is simple in construction and which can be constructed with various commercially available parts.

Other features and advantages of the present invention will become apparent from the description set forth below with reference to the accompanying drawings.

DETAILED DESCRIPTION OF THE INVENTION

Figure 1:
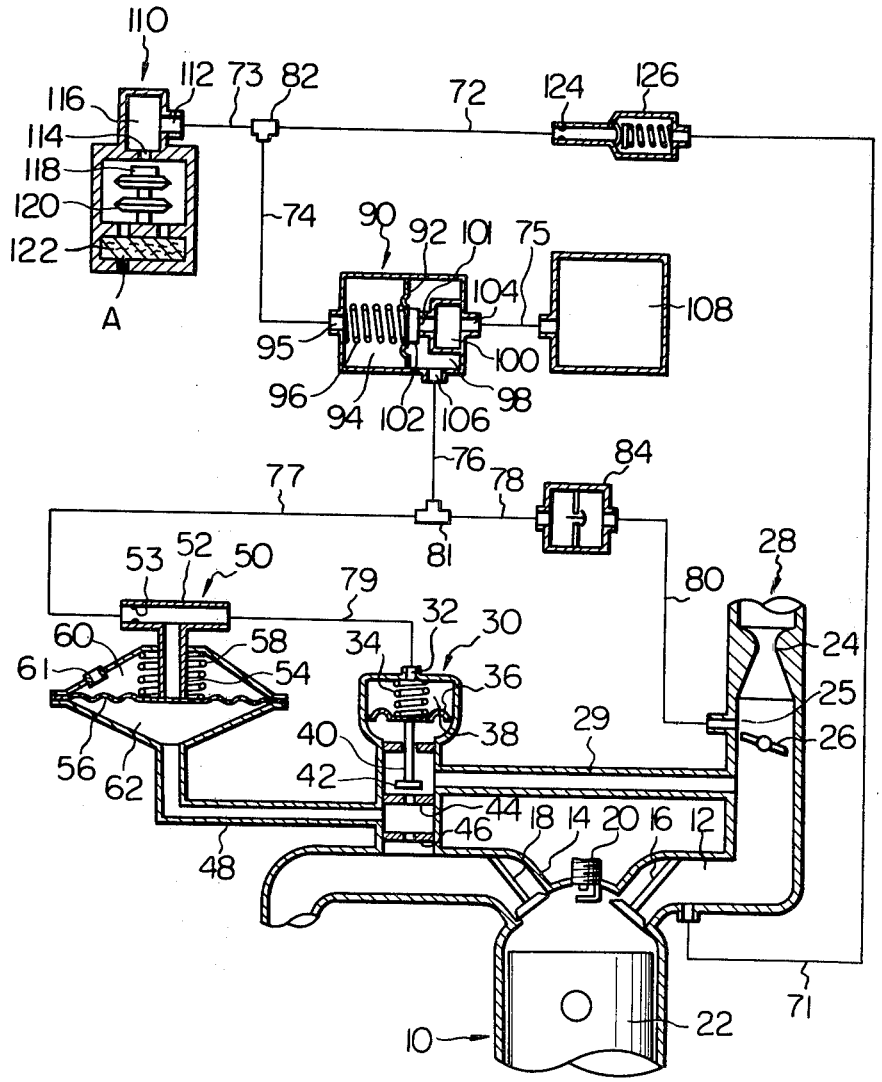
FIG. 1 is an elevational view which shows a first embodiment according to the present invention.

A first embodiment according to the present invention is explained hereinafter with reference to accompanying FIG. 1. Referring to FIG. 1, an engine 10 is provided with an intake manifold 12, an exhaust manifold 14, an intake valve 16 for controlling the intake mixture flowing from the intake manifold 12 into a cylinder 11, an exhaust valve 18 for controlling the exhaust gas flowing from the cylinder 11 into the exhaust manifold 14, an ignition plug 20 and a piston 22 which can reciprocate in the cylinder 11. The intake manifold 12 is communicated with a carburetor 28 which comprises a venturi throat 24 and a throttle valve 26. The intake manifold 12 and the exhaust manifold 14 are communicated with each other via an exhaust gas recirculation control valve device 30 and a communicating pipe 29. The exhaust gas recirculation control valve device 30 comprises a diaphragm chamber 38, partitioned by a diaphragm 36, which is provided with a vacuum port 32 and a spring 34 for urging the diaphragm 36; a valve 42 connected to the diaphragm 36 via a valve rod 40; a valve seat 44 which cooperates with the valve 42 for controlling the amount of vacuum supplied from the exhaust manifold 14; and an orifice 46 disposed at a position upstream of the valve seat 44. A position downstream of the orifice 46 is communicated with a lower diaphragm chamber 62 of a modulator valve device 50 via a communicating pipe 48. The modulator valve device 50 comprises a T-shaped vacuum conduit 52 which has a throttling element 53 disposed therein and a nozzle 54 formed at the bottom end thereof; a diaphragm 56 located opposite the nozzle 54 for partitioning the inside of the modulator valve device 50 into an upper diaphragm chamber 60 and the lower diaphragm chamber 62; and a spring 58 disposed within the upper diaphragm chamber 60 for urging the diaphragm 56 downward. The upper diaphragm chamber 60 has a port 61 for communicating with atmosphere. The vacuum conduit 52 is communicated with the vacuum port 32 of the exhaust gas recirculation control valve device 30 via a vacuum pipe 79 and is further communicated with a check valve 84 for preventing a reverse vacuum flow from occurring via vacuum pipes 77 and 78. The check valve 84 is further communicated with a vacuum port 25 disposed upstream of a position which faces to the edge of the throttle valve 26 of the carburetor 28 when the throttle valve 26 is closed. Accordingly, the check valve 84 prevents air introduced from the port 61 of the modulator valve device 50 from flowing into the carburetor 28 through the vacuum port 25. The vacuum pipes 77 and 78 are connected to a T-shaped connector 81 which communicates with an inlet port 106 of a control valve device 90 via a vacuum pipe 76. The control valve device 90 is provided with a diaphragm 92 for separating a left diaphragm chamber 94 from a right diaphragm chamber 98. The left diaphragm chamber 94 is provided with a vacuum port 95 and a spring 96 for urging the diaphragm 92. The right diaphragm 98 comprises a valve chamber 100 formed therein; a valve 102 which is fixed to the diaphragm and, which cooperates with an opening 101 formed at a top end of the valve chamber 100; an outlet port 104 formed at an end of the valve chamber 100; and an inlet port 106 formed on a wall of the right diaphragm chamber 98. When the force acting on the diaphragm 92 caused by the vacuum supplied from the vacuum port 95 is larger than the force caused by the spring 96, the outlet port 104 is communicated with the inlet port 106 via the opening 101 and the valve chamber 100. The outlet port 104 is communicated with a reservoir tank 108, having a predetermined volume, for storing a vacuum supplied through a vacuum pipe 75. The vacuum port 95 is communicated with a T-shaped connector 82 via a vacuum pipe 74. One end of the T-shaped connector 82 is communicated with a vacuum port 112 of an altitude compensating device 110, via a vacuum pipe 73 and the other end of the T-shaped connector 82 is communicated with the intake manifold 12 of the engine 10 via a vacuum pipe 72, a check valve 126 which contains a throttling element 124 and which prevents a reverse vacuum flow from occurring, and a vacuum pipe 71. The altitude compensating device 110 comprises: a valve casing 116 which is provided with the vacuum port 112 and an atmospheric port 114; and an aneroid bellows 120 which is filled with a gaseous medium having a predetermined pressure (for example, 1 kg/cm$^2$ of air) and which has a valve 118 disposed at an end thereof for cooperating with the atmospheric port 114 in accordance with changes in the atmospheric pressure. As a result, the valve 118 is displaced downwardly due to the displacement of the aneroid bellows 120 during low altitudes. Air (shown by an arrow A) is then introduced through a filter 122 and the atmospheric port 114 to fill the left diaphragm chamber 94 of the control valve device 90. (The check valve 126 prevents atmospheric air supplied from the altitude compensating device 110 from flowing into the intake manifold 12). On the other hand, during high altitudes, the valve 118 is displaced upwardly due to the displacement of the aneroid bellows 120.

Thereafter, vacuum supplied from the intake manifold 12 fills the valve casing 116 of the altitude compensating device 110 and the left diaphragm chamber 94 of the control valve device 90. As a result, the diaphragm 92 is displaced to the left and then the inlet port 106 is caused to communicate with the outlet port 104.

The operation of the exhaust gas recirculation engine shown in FIG. 1 will be explained hereinafter.

(1) When a vehicle comprising the engine shown in FIG. 1 is operating at high altitudes.

As mentioned above, since the valve 118 of the altitude compensating device 110 is displaced upwardly and causes communication between the inlet port 106 and the outlet port 104, the vacuum supplied from the vacuum port 25 is stored within the reservoir tank 108 and simultaneously supplied to the diaphragm chamber 38 of the exhaust gas recirculation control valve device 30 through the modulator valve device 50. When the pressure of the vacuum supplied from the vacuum port 25 is sufficiently high, the valve 42 is displaced upwardly due to the displacement of the diaphragm 36. A part of the exhaust gas is then recirculated from the exhaust manifold 14 to the intake manifold 12 through the exhaust gas recirculation valve device 30. Next, if the opening of the throttle valve 26 is increased, the pressure of the vacuum supplied from the vacuum port 25 is decreased. When the force caused by the vacuum pressure is less than the urging force of the spring 34 of the exhaust gas recirculation control valve device 30, the valve 42 is closed and then recirculation of the exhaust gas is stopped. Since conventional exhaust gas recirculation engines are not intended for high altitude use, the conventional exhaust gas recirculation control valve device is closed at high altitudes in response to the increased opening of the throttle valve 26. As a result, the conventional exhaust gas recirculation engines cannot fully carry out the reduction of the harmful $NO_x$ contaminants contained in the exhaust gas at high altitudes. On the contrary, the exhaust gas recirculation engine shown in FIG. 1 can store vacuum supplied from the vacuum port 25 within the reservoir tank 108 at high altitudes. Accordingly, the opening of the throttle valve 26 can be increased, and the pressure of the vacuum supplied from the vacuum port 25 can be lowered. Vacuum stored in the reservoir tank 108 is supplied from the reservoir tank 108 to the exhaust gas recirculation control valve device 30 through the inlet and outlet ports 104, and 106 of the control valve device 90, the valve 102 of which is open at high altitude. As a result, the exhaust gas recirculation control valve device 30 is actuated until the vacuum stored in the reservoir tank 108 is fully consumed. Consequently, the engine shown in FIG. 1 can effect the advantage wherein harmful $NO_x$ contaminants contained in the exhaust gas can be prevented from increasing at high altitudes.

(2) When the vehicle comprising the engine shown in FIG. 1 is operating at low altitudes.

The valve 118 of the altitude compensating device 110 is displaced downwardly due to the displacement of the aneroid bellows 120. Thereafter, the left diaphragm chamber 94 of the control valve device 90 is filled with atmospheric air and the valve 102 is closed. As a result, since the valve 102 is closed, no vacuum can be supplied from the reservoir tank 108 to the exhaust gas recirculation control valve device 30 when the pressure of the vacuum supplied from the vacuum port 25 is decreased below the predetermined level. In other words, the exhaust gas is stopped from recirculating in response to the increased opening of the throttle valve 26, and a drop in the engine power can be prevented from occurring.

It is preferable that the time interval, during which exhaust gas recirculation is continued after the opening of the throttle valve 26 has been increased be adjusted within 0 to 10 seconds, more preferably within 1 to 5 seconds, which time interval can be adjusted by selecting the volume of the reservoir tank 108.

Figure 2:
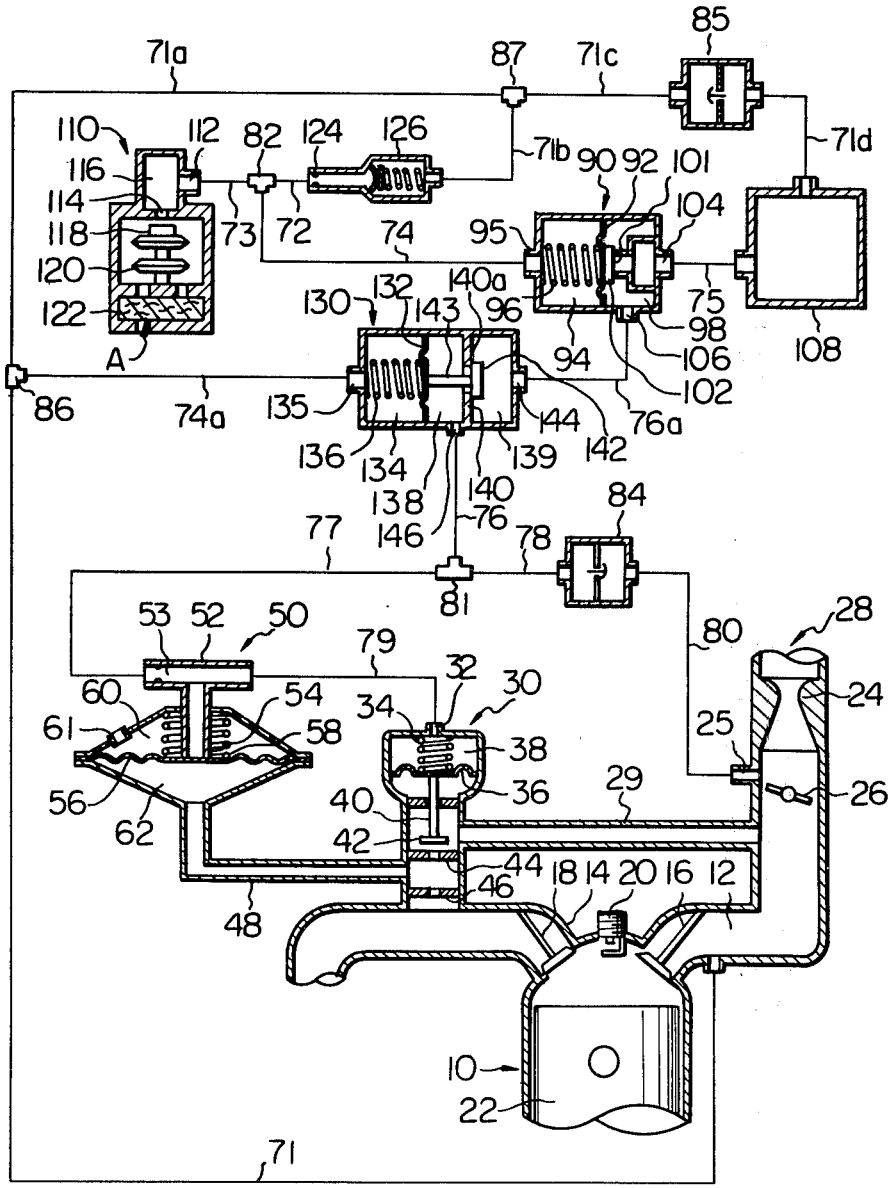
FIG. 2 is an elevational view which shows a second embodiment according to the present invention.

Another embodiment will be now explained with reference to FIG. 2. The exhaust gas recirculation engine shown in FIG. 2 is the same as that shown in FIG. 1 except that (a) the vacuum stored in a reservoir tank is supplied from the intake manifold instead of the vacuum port of FIG. 1 and that (b) the vacuum supplied from the reservoir tank to the exhaust gas recirculation control valve is controlled by not only the control valve actuated by vacuum supplied from the altitude compensating device but also by an additional control valve device actuated by vacuum supplied from the intake manifold. Therefore, the same parts in FIG. 2 as in FIG. 1 are designated with the same reference numerals and an explanation therefor is omitted herein.

The vacuum pipe 71 communicating with the intake manifold 12 is communicated with the check valve 126 via T-shaped connectors 86 and 87 and vacuum pipes 71*a* and 71*b*. The T-shaped connector 87 is also communicated with the reservoir tank 108 via vacuum pipes 71*c*, 71*d* and a check valve 85. As a result, while the pressure of the vacuum supplied from the intake manifold 12 is higher than that in the reservoir tank 108, vacuum supplied from the intake manifold 12 is stored in the reservoir tank 108. On the contrary, when the pressure of the vacuum in the reservoir tank 108 is higher than that of the vacuum supplied from the intake manifold 12, vacuum is prevented from flowing into the reservoir tank 108 by the check valve 85.

The one end of the T-shaped connector 86 is communicated with a vacuum port 135 of a second control valve device 130 via a vacuum pipe 74*a*. The second control valve device 130 comprises a left diaphragm chamber 134 and a right diaphragm chamber 138 partitioned from each other by a diaphragm 132. The left diaphragm chamber 134 is provided with the vacuum port 135 and a spring 136 for urging the diaphragm 132. The right diaphragm chamber 138 is also separated from a chamber 139 by a plate 140. Each of the chambers 138 and 139 is provided with a port 146 or 144, and the valve plate 140 has a valve seat 140*a* formed thereon. A valve 142, connected to the diaphragm 132 via a valve rod 143, cooperates with the valve seat 140*a*. The port 146 is communicated with the vacuum pipe 76, and the port 144 is communicated with the inlet port 106 of the first control valve device 90 via a vacuum pipe 76*a*. As a result, when the pressure of the vacuum supplied from the vacuum port 135 is sufficiently high, the valve 142 is closed. On the other hand, when the vacuum pressure supplied through the vacuum port 135 is decreased, the valve 142 is opened due to the urging force of the spring 136, then the port 146 is communicated with the port 144.

The operation of the exhaust gas recirculation engine shown in FIG. 2 will be explained hereinafter.

(1) When a vehicle comprising the engine shown in FIG. 2 is operating at high altitudes.

Vacuum supplied from the intake manifold 12 to the reservoir tank 108 through the vacuum pipes 71, 71*a* and 71*c* and through the check valve 85 is stored within the reservoir tank 108. Since the altitude at which the vehicle is operating is higher than a predetermined level of the aneroid bellows 120, the valve 118 of the altitude compensating device 110 is closed, then vacuum is supplied from the intake manifold 12 to the first control valve device 90 through the vacuum pipes 71, 71*a* and 71*b*, the check valve 126 and the vacuum pipe 74. As a result, the valve 102 is opened and the inlet port 106 is communicated with the outlet port 104.

When the throttle valve 26 is opened within a predetermined range, the pressure of the vacuum supplied from the vacuum port 25 is sufficiently high. As a result, vacuum supplied from the vacuum port 25 to the exhaust gas recirculation valve device 30 through the vacuum pipe 80, the check valve 84 and the vacuum pipes 78 and 77 causes the valve 42 to be opened. Accordingly, a part of the exhaust gas is recirculated from the exhaust manifold 14 into the intake manifold through the exhaust gas recirculation control valve device 30. In this case, since the pressure of the vacuum supplied from the intake manifold 12 to the second control valve device 130 through the vacuum pipes 71, 74*a* is sufficiently high, the valve 142 is closed. As a result, vacuum in the reservoir tank 108 is not supplied to the exhaust gas recirculation control device 30.

On the other hand, when the opening of the throttle valve 26 is increased, the pressure of the vacuum supplied from the vacuum port 25 is decreased. At the same time the pressure of the vacuum supplied from the intake manifold 12 is also decreased. As a result, the valve 142 of the second control valve device 130 is opened, then vacuum supplied from the reservoir tank 108 through the first control valve device 90 is supplied to the exhaust gas recirculation control valve device 30. In this case, since the pressure of the vacuum supplied from the intake manifold 12 is lower than that of the vacuum stored in the reservoir tank 108, the vacuum flow from the intake manifold 12 to the reservoir tank 108 is prevented from occurring by the check valve 85.

Vacuum is supplied from the reservoir tank 108 to the exhaust gas recirculation control valve 30 until vacuum stored in the reservoir tank 108 is consumed. Meanwhile exhaust gas is recirculated from the exhaust manifold 14 to the intake manifold 12.

(2) When the vehicle comprising the engine shown in FIG. 2 is operating at low altitudes.

Since the valve 118 of the altitude compensating device 110 is open, atmospheric air introduced through the filter 122 and the atmospheric port 114 is supplied to the first control valve device 90, and the valve 102 is accordingly closed. As a result, since vacuum flow from the reservoir tank 108 is prevented from occurring, the exhaust gas recirculation engine shown in FIG. 2 is operated in a manner similar to that of a conventional exhaust gas recirculation engine at low altitudes.

In the engine shown in FIG. 2, since the vacuum supplied from the intake manifold, the pressure of which vacuum is higher than that of the vacuum supplied from the vacuum port of the carburetor, is stored in the reservoir, the operation of the engine is surely actuated when the throttle valve is opened at high altitudes.

What we claim is:

1. An exhaust gas recirculation engine for high altitude use which is provided with an exhaust gas recirculation control valve means for communicating the intake system of said engine with the exhaust system of said engine for recirculating a part of the exhaust gas extracted from said exhaust system into said intake system, the actuation of said exhaust gas recirculation control valve means is controlled by vacuum which is supplied from a vacuum port disposed at a position adjacent to a throttle valve of said intake system, wherein said exhaust gas recirculation engine further comprises:

a reservoir means communicated with a first vacuum supply means for storing vacuum supplied from said first vacuum supply means;

a control valve means communicated with both said reservoir means and said exhaust gas recirculation control valve means for controlling the delivery of the vacuum from said reservoir means to said exhaust gas recirculation control valve means; and an altitude compensating means for actuating said control valve means in accordance with altitude, whereby when said exhaust gas recirculation control valve means is closed due to a drop in the vacuum supplied from said vacuum port, which drop being caused by the opening operation of said throttle valve at high altitudes, said exhaust gas recirculation control valve means is supplied the stored vacuum from said reservoir means and said valve means is closed after a predetermined delay time.

2. An exhaust gas recirculation engine for high altitude use according to claim 1 wherein said altitude compensating means is communicated with a second vacuum supply means via a check valve, which prevents reverse vacuum flow from occurring, for supplying an actuating vacuum to said control valve means in accordance with altitude.

3. An exhaust gas recirculation engine for high altitude use according to claim 2, wherein said altitude compensating means comprises a valve chamber, which is provided with an inlet port communicated with said second vacuum supply means and a valve seat communicated with the atmosphere, and a valve member, displaced in accordance with changes in the atmospheric pressure, for controlling the vacuum supplied through said inlet port to said valve chamber due to the cooperation thereof with said valve seat, said inlet port of said altitude compensating means is communicated with said second vacuum supply means via said check valve so that, when said valve chamber is communicated with the atmosphere through said valve seat, said check valve prevents atmospheric air flow to said second vacuum supply means from occurring.

4. An exhaust gas recirculation engine for high altitude use according to claim 1, wherein said engine further comprises a vacuum passage and a check valve for preventing a reverse vacuum flow from occurring, both of said passage and check valve being disposed in series between said exhaust gas recirculation control valve means and said vacuum port, said vacuum passage is constructed as said first vacuum supply means which is communicated with said control valve means, whereby at high altitudes, when said throttle valve is opened within a predetermined range, the vacuum supplied from said vacuum port is supplied to both said exhaust gas recirculation control valve means and said reservoir means; and when said throttle valve is opened fully so that the pressure of the vacuum supplied from said vacuum port is lower than a predetermined level, the vacuum stored in said reservoir means is supplied to said exhaust gas recirculation valve means for a predetermined interval of time.

5. An exhaust gas recirculation engine for high altitude use according to claim 1, wherein said engine further comprises a vacuum passage, a check valve for preventing a reverse vacuum flow from occurring, both of said passage and check valve being disposed in series between said exhaust gas recirculation control valve means and said vacuum port, and a second control valve means, communicating said vacuum passage with said first control valve means, which second valve means supplies the vacuum stored in said reservoir means to said exhaust gas recirculation control valve means when the pressure of the vacuum supplied from said vacuum port is lower than a predetermined level due to the opening of said throttle valve.

6. An exhaust gas recirculation engine for high altitude use according to claim 5, wherein said reservoir means is communicated with said first vacuum supply means via a check valve which permits the vacuum flow to pass from said first vacuum supply means to said reservoir means while the pressure of the vacuum supplied from said first vacuum supply means is higher than that of the vacuum in said reservoir means, and which prevents a reverse vacuum flow from occurring when the pressure of the vacuum supplied from said first vacuum supply means is lower than that of the vacuum in said reservoir means.

7. An exhaust gas recirculation engine for high altitude use according to claim 1, wherein said engine further comprises a vacuum passage being constructed as said first vacuum supply means and being communicated with said control valve means, a first check valve for preventing a reverse vacuum flow from occurring, both of said passage and said check valve being disposed in series between said exhaust gas recirculation control valve means and said vacuum port, and a second check valve communicating said altitude compensating means with an intake passage of said engine and preventing said reverse vacuum flow from occurring, whereby said control valve means is actuated by the vacuum supplied from said intake passage through said second check valve and through said altitude compensating means at high altitudes for permitting the vacuum to flow between said reservoir means and said vacuum passage.

8. An exhaust gas recirculation engine for high altitude use according to claim 1, wherein said engine further comprises a vacuum passage, a check valve for preventing a reverse vacuum flow from occurring, both of which are disposed in series between said exhaust gas recirculation control valve means and said vacuum port, a second control valve means, which communicates said vacuum passage with said first control valve means for permitting the vacuum flow to pass from said reservoir means to said vacuum passage when, due to the opening of said throttle valve, the pressure supplied from said vacuum port is lower than a predetermined level at which said exhaust gas recirculation control valve is actuated, and a second check valve which communicates said altitude compensating means with a second vacuum flow from occurring.

9. An exhaust gas recirculation engine for high altitude use according to claim 1, wherein said engine further comprises a vacuum passage, a check valve for preventing a reverse vacuum flow from occurring, both of said passage and said check valve being disposed in series between said exhaust gas recirculation control valve means and said vacuum port, a second control valve means actuated by the vacuum supplied from an intake passage of said engine, a second check valve means which communicates said altitude compensating means with said intake passage of said engine for preventing said reverse vacuum flow from occurring, and a third check valve which communicates said reservoir means with said intake passage constructed as said first vacuum supply means for preventing said reverse vacuum flow from occurring.

* * * * *